US007810543B2

(12) United States Patent
Donatelli et al.

(10) Patent No.: US 7,810,543 B2
(45) Date of Patent: Oct. 12, 2010

(54) ROLLER SCREEN DEVICE

(75) Inventors: Francesco Donatelli, Grottaglie (IT); Samuele Donatelli, Grottaglie (IT); Michele Motolese, Grottaglie (IT)

(73) Assignee: Effe S.r.l., Grottaglie, TA (IT)

( * ) Notice: Subject to any disclaimer, the term of this patent is extended or adjusted under 35 U.S.C. 154(b) by 102 days.

(21) Appl. No.: 12/001,558

(22) Filed: Dec. 11, 2007

(65) Prior Publication Data

US 2009/0145560 A1 Jun. 11, 2009

(51) Int. Cl.
*A47H 1/00* (2006.01)
*A47H 5/00* (2006.01)
*E05D 15/06* (2006.01)

(52) U.S. Cl. ..... 160/31; 160/84.06; 160/194

(58) Field of Classification Search ..... 160/23.1, 160/84.06, 31, 194, 201, 240, 268.1, 271, 160/272, 277, 279
See application file for complete search history.

(56) References Cited

U.S. PATENT DOCUMENTS

| | | | | |
|---|---|---|---|---|
| 4,433,630 | A * | 2/1984 | Laborie | 108/50.02 |
| 4,993,468 | A * | 2/1991 | Hackman et al. | 160/27 |
| 6,082,432 | A * | 7/2000 | Kissinger | 160/290.1 |
| 6,186,212 | B1 * | 2/2001 | Tsuchida | 160/84.06 |
| 2007/0039698 | A1 * | 2/2007 | Chino et al. | 160/84.06 |
| 2007/0209767 | A1 * | 9/2007 | Bonini | 160/382 |

FOREIGN PATENT DOCUMENTS

| | | |
|---|---|---|
| EP | 0 999 335 A1 | 11/1999 |
| EP | 1 333 148 A2 | 1/2003 |
| EP | 1 333 148 | 8/2003 |
| EP | 1 640 554 A1 | 5/2004 |

* cited by examiner

*Primary Examiner*—Katherine W Mitchell
*Assistant Examiner*—Jaime F Cardenas-Garcia
(74) *Attorney, Agent, or Firm*—Merchant & Gould P.C.

(57) ABSTRACT

A roller screen device includes a fixed sectional element (10) and a mobile sectional element (11) that is able to move parallel to the fixed sectional element inside a frame contained in which is a screen (13), the mobile sectional element (11) bearing a roller (12) inside it, wound on which is the screen (13), which, at the other end, is anchored to the fixed sectional element (10). Guide elements (14 and 24) for guiding the mobile sectional element (11) are positioned at the top and at the bottom of the screen (13) and fixed at one end to the mobile sectional element (11), while the other ends of the guide elements (14) slide into the fixed sectional element (10). Moreover provided is a system for tensioning the guides (14 and 24), which acts during the steps of opening and closing of the screen (13). The tensioning system includes a thread (20), which extends starting from the end (21) of the top guide (14) that slides in the fixed sectional element (10) towards and around a bottom roller (22) and from here to the end (23) of the bottom guide (24), which slides in the fixed sectional element (10), to proceed to and around a top roller (25) and from here to the end (21) of the top guide (14) so closing to form a loop.

6 Claims, 3 Drawing Sheets

ROLLER SCREEN DEVICE

BACKGROUND OF THE INVENTION

Roller screen devices, in which the screen is, for example, a mosquito net, are devices in which the screen is wound on a roller carried by a vertical sectional element fixed to the frame and is fixed, at its free end, to the sectional element, which slides by being pulled manually for opening and closing the screen itself.

In addition, the systems for guiding the screen so that it opens and closes slide inside the other sectional element, the one that is translated manually to open and close the screen.

A typical example of the above embodiment is represented by the screen described in the patent No. EP-1,333,148.

SUMMARY OF THE INVENTION

The present invention proposes a solution in which, instead, set in the mobile sectional element is the roller around which the screen winds, and sliding in the fixed sectional element are the systems for guiding the screen.

One of the advantages of the above solution lies in the fact that, in this way, it is possible to set and move conveniently in the fixed sectional element all the sliding systems of the screen in so far as the screen, when it is wound up, comes to occupy, with extremely limited encumbrance, the sectional element that slides when pulled manually.

It is evident that a solution in which the movement systems are located in a fixed part of the device, whilst the roller for winding the screen can even remain conveniently in the sliding sectional element proves to be very reliable, with the further advantage that the latter sectional element, since it carries the winding roller and not the movement system, is of very small overall dimensions with consequent advantages also from an aesthetic point of view. Furthermore, thanks to the fact that the winding roller is mounted in the mobile sectional element, the device according to the invention enables provision of assembly kits that can be easily used even by non-skilled persons, such as, for example, the end user, who in an extremely simple way will be able to construct the screen with the desired dimensions or to replace a screen that has worn out without any difficulty.

For the above and further purposes that will be understood more fully hereinafter, the purpose of the invention is to provide a roller screen device constituted by a fixed sectional element and a mobile sectional element that is able to move parallel to the fixed sectional element inside a frame contained in which is a screen, the mobile sectional element bearing a roller inside it, wound on which is the screen, which, at the other end, is anchored to the fixed sectional element; elements for guiding the mobile sectional element are positioned at the top and at the bottom of the screen and fixed at one end of their own to the mobile sectional element, whilst the other ends of the guide elements slide into the fixed sectional element; moreover provided is a system for tensioning the guides, which acts during the steps of opening and closing of the screen; the device is characterized in that the tensioning system consists of a thread, which extends starting from the end of the top guide that slides in the fixed sectional element towards and around a bottom roller and from here to the end of the bottom guide, which slides in the fixed sectional element, to proceed to and around a top roller and from here to the end of the top guide so closing to form a loop.

BRIEF DESCRIPTION OF THE DRAWINGS

The invention will now be described with reference to the attached drawings, in which:

FIGS. 3 and 4 each illustrate in two different views two details of the device according to the invention.

DETAILED DESCRIPTION OF THE PREFERRED EMBODIMENT(S)

Figure 1:
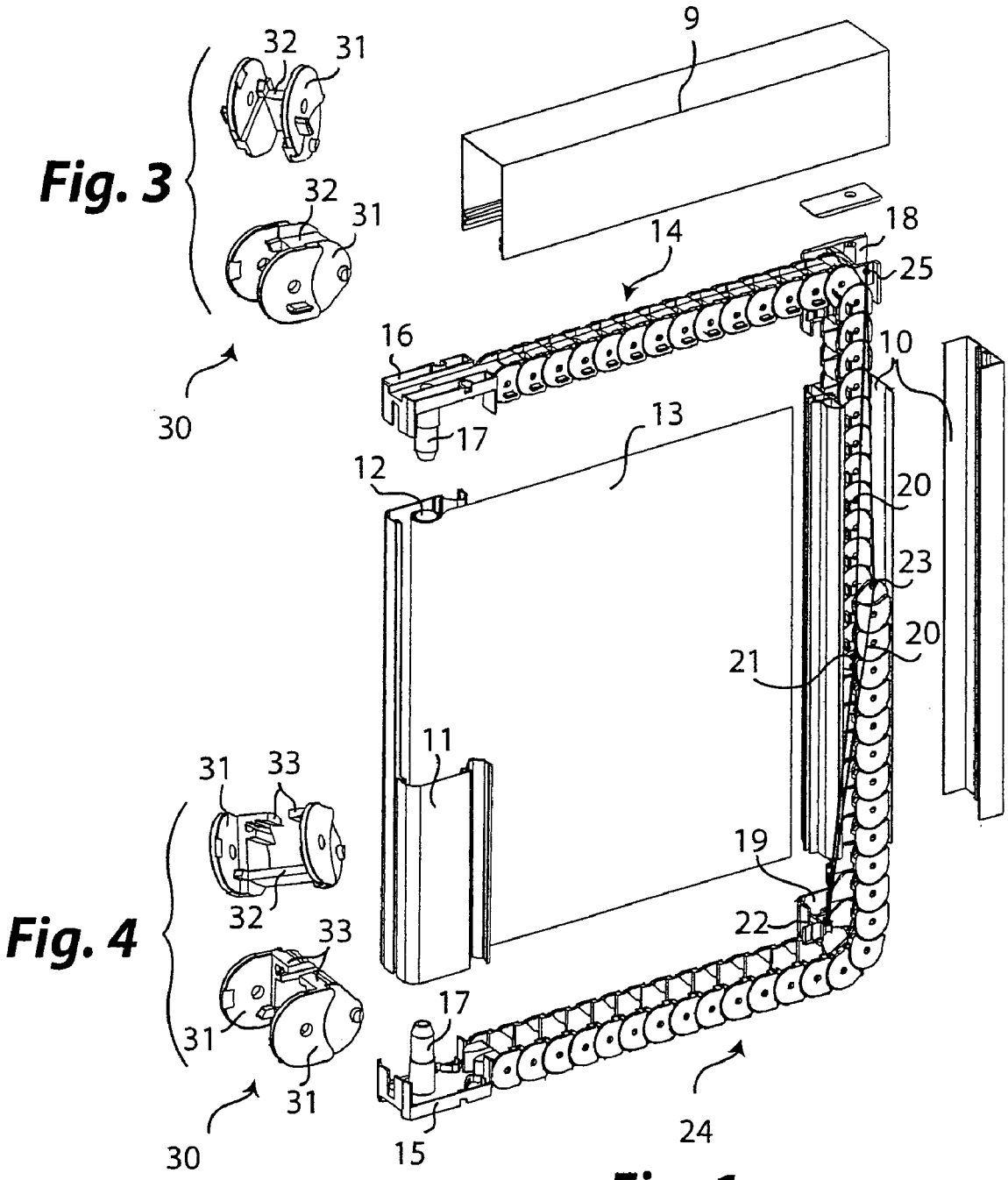
FIGS. 1 and 2 are, respectively, an exploded perspective view and an exploded front view of the device according to the invention.
Figure 2:
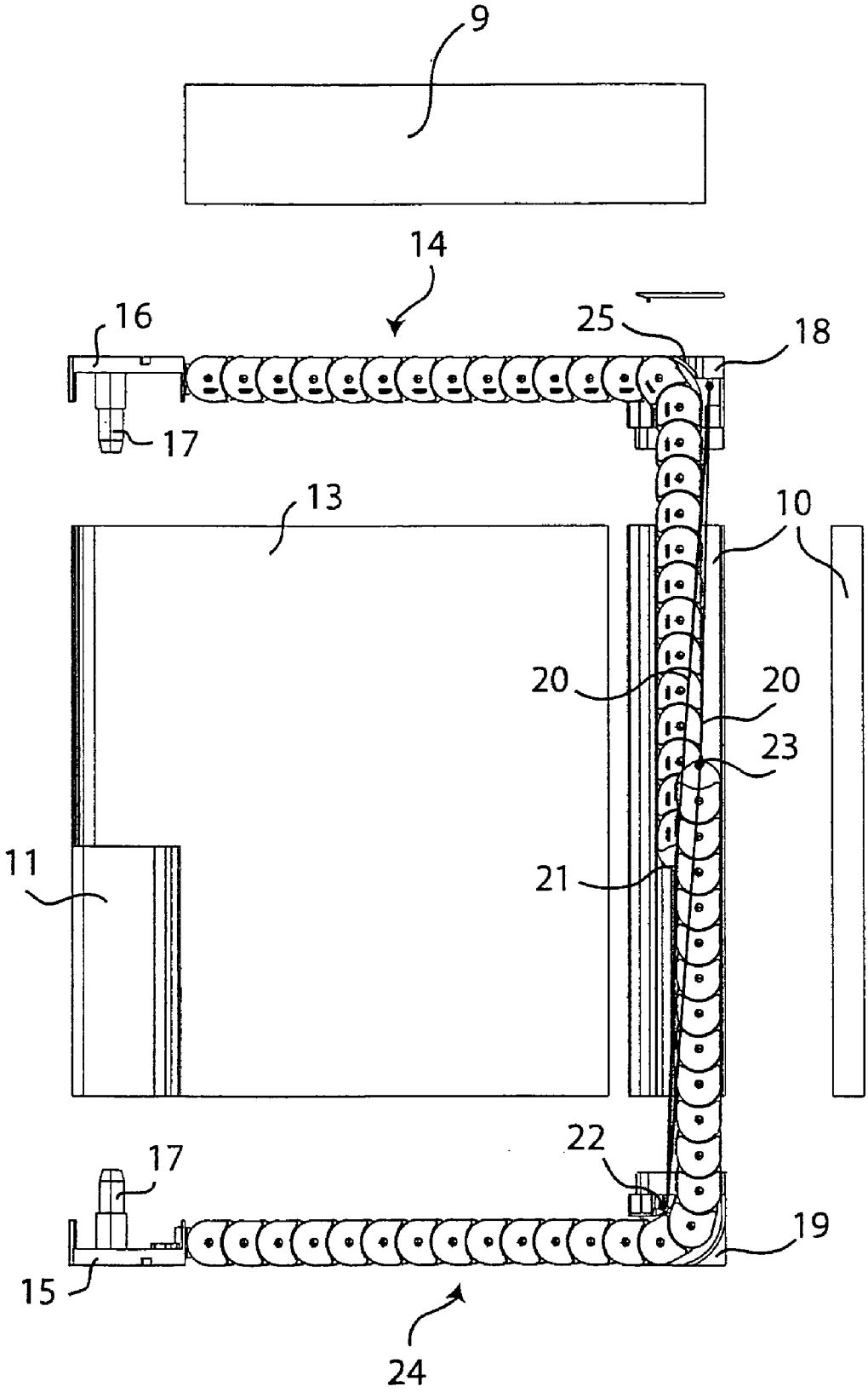

The screen has a fixed sectional element 10 and a mobile sectional element 11. The latter bears an internal roller 12, wound on which is the screen 13, which, at the other end, is anchored to the fixed sectional element 10.

Guide elements 14 and 24 are positioned at the top and at the bottom and fixed at one end of their own to respective end pieces 15 and 16, which are provided with pins 17, which slide with interference into the bottom and top ends of the roller 12. The other ends of the guide elements 14 pass through the end pieces 18 and 19 of the fixed sectional element 10 and slide into the latter.

The guides 14 slide in a guide 9 carried by the frame and are sized in such a way that they slide into one another in order to reduce further the overall dimensions.

Each top guide element 14 and bottom guide element 24 (see FIGS. 3 and 4) is made up of bodies 30 hinged to one another and formed by side walls 31 joined by cross members 32.

Figure 5:
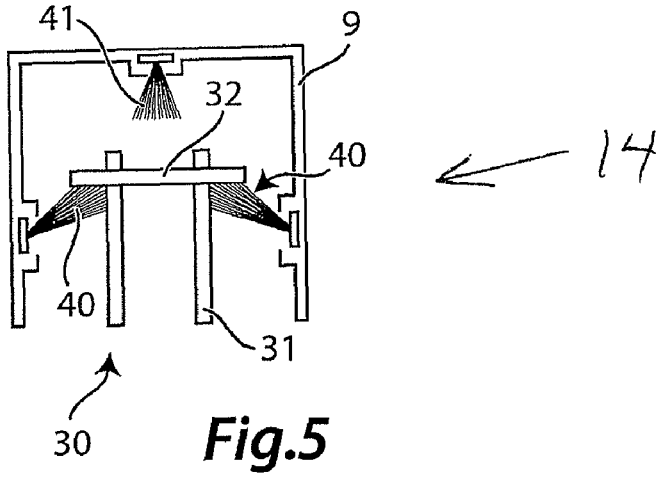
FIGS. 5 and 6 illustrate two variant embodiments of details of the device according to the invention.

According to a variant embodiment illustrated in FIG. 5, the inside of the top guide 9 within which the bodies 30 slide is provided with lateral brushes 40 and top brushes 41. The lateral ones, which press against the walls 31 of the bodies 30 have the task of maintaining the latter in a rectilinear position during sliding during opening and closing of the mosquito net, whilst the top one 41 has the task of preventing any sticking of the bodies 30 against the guide 9 once again during sliding.

Moreover provided is a system for tensioning the guides 14 and 24, which acts during the steps of opening and closing of the screen 13.

The above system consists of a thread 20, entirely contained in the fixed sectional element 10, which extends starting from the end 21 of the top guide 14 towards and around a bottom roller 22 of the end piece 19 and from here to the end 23 of the bottom guide 24, and then proceeds towards and around a top roller 25 of the end piece 18 and from here to the end 21 of the top guide 14, so closing to form a loop.

In this way, the assembly proves extremely compact and functional. It may be noted, in particular, that the hinges on the rollers 22 and 25 are made one, in 22, inside between the guides 14 and 24 and the screen 13, whilst the other, in 25, is immediately outside of the guide 14 but within the vertical overall dimensions of the guide 24. This determines a high compactness of the tensioning system to advantage of the reduced dimensions of the sectional element 10 in which the system is located.

According to a first embodiment illustrated in FIG. 4, the bottom guide 24 is advantageously provided with brushes that extend inwards penetrating into the meshes of the screen to prevent the latter from coming out of the guide itself in the case of wind or excessive pressure exerted on the screen 13 itself.

The brushes will be applied to the ends of appendages 33 set in front of one another of the elements 30 that form the bottom guide so that the bottom of the screen will be set inserted between the brushes of the entire guide.

Figure 6:
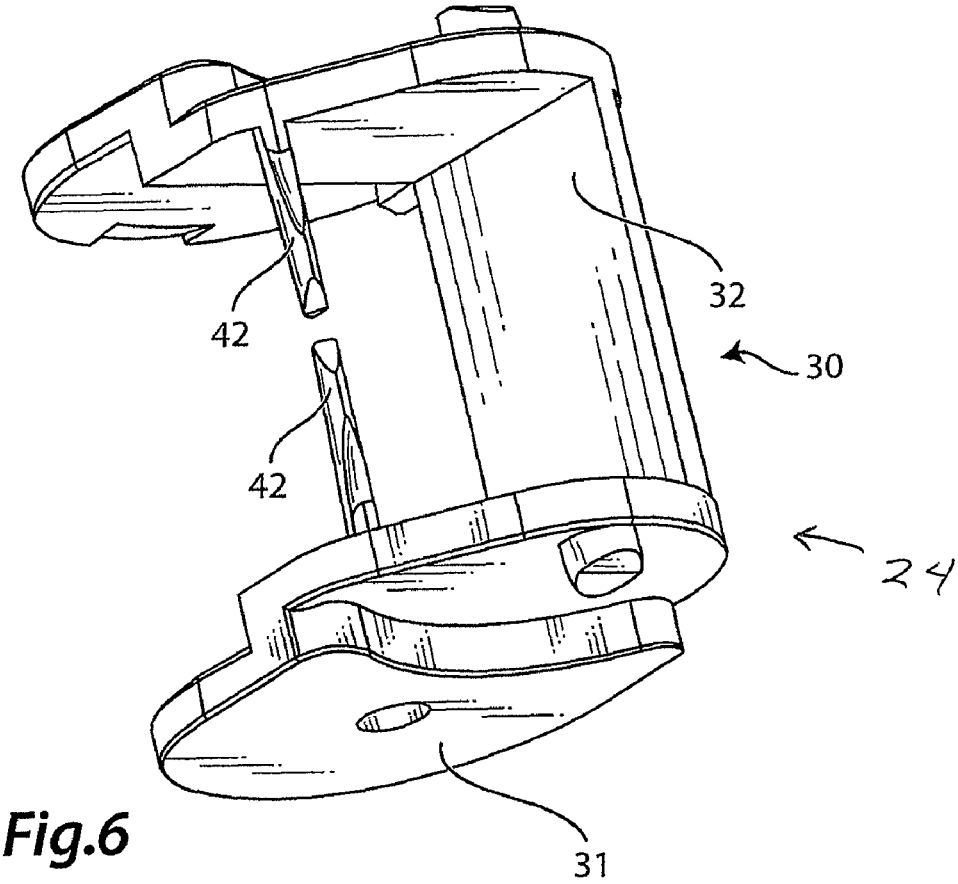

According to a variant embodiment illustrated in FIG. 6, the bottom guide 24 is even more advantageously provided with coaxial rigid stalklike projections 42, which extend inwards from the elements 30 that form the bottom guide 24 so as to slide into the meshes of the screen in order to prevent the latter from coming out of the guide itself in the case of wind or excessive pressure exerted on the screen 13 itself.

The solution provided by the stalklike projections 42 has proven more valid than that of the brushes in so far as it is more rigid and more solid and hence more resistant even in the case of quite a strong wind.

Since the end pieces 16 and 15 are readily removable and the screen 13 is simply slid into the purposely provided seat of the roller 12, it is very simple to detach the top end piece 16 and slide out the roller 12 with the screen 13, after disengaging the latter from its constraint to the fixed sectional element 10. In this way the screen can be readily replaced with a new one.

The assembly kit will envisage the sectional element 11 with the roller 12 and the screen 13 wound on the roller.

The manufacturer will not even have to provide screens 13 of various sizes since the task of cutting the screen 13 to the right size in height according to the dimensions of the device on which it is to be mounted will be left to the user or the installer. The rest of the operation, i.e., re-mounting of the end piece 16, is extremely simple and within the reach of any person.

In this way, it is simple to provide assembly kits proper, and anybody can use them without any difficulty.

Finally, given the complete modularity of the device, the latter may even not be fixed to a wall but can slide from one part to the other within a window opening of large dimensions. In addition, it can be coupled to other mosquito nets of the same type to form a set of a number of mosquito nets that can all slide within a large window opening.

The invention claimed is:

1. A roller screen device comprising:

a fixed sectional element;

a mobile sectional element configured to move parallel to the fixed sectional element inside a frame;

a roller inside the mobile sectional element;

a screen wound at a first end around the roller and anchored at a second end to the fixed sectional element;

guide elements, forming a top guide and a bottom guide for guiding the mobile sectional element, positioned at the top and at the bottom of the screen and both said top and bottom guides fixed at a respective first end to the mobile sectional element, wherein second ends of the top and bottom guides slide into the fixed sectional element;

a system for tensioning the top guide and the bottom guide during the steps of opening and closing of the screen, wherein the tensioning system includes a thread, which extends starting from the second end of the top guide that slides in the fixed sectional element towards and around a bottom roller and further extends to the second end of the bottom guide, which slides in the fixed sectional element, to proceed to and around a top roller and to the second end of the top guide, said thread closing to form a loop, the top guide and the bottom guide being sized to slide inside one another in the fixed sectional element.

2. The device according to claim 1, wherein said top and bottom guides are fixed at one end to the mobile sectional element and to respective end pieces provided with pins that slide with interference in the top and bottom ends of the roller.

3. The device according to claim 1, wherein said top and bottom guides comprise bodies hinged to one another, said bodies comprising lateral walls joined by cross members.

4. The device according to claim 1, wherein the screen comprises a mesh, and wherein the bottom guide is provided with brushes that extend inwards from the guide elements that form the bottom guide penetrating into the mesh of the screen to prevent the screen from coming out of the guide.

5. The device according to claim 1, wherein the screen comprises a mesh, and wherein the bottom guide is provided with coaxial rigid projections, which extend inwards from the guide elements that form the bottom guide so as to slide into the mesh of the screen to prevent the screen from coming out of the bottom guide.

6. The device according to claim 1, wherein the guide elements of the top guide slide within a fixed sectional element, which is provided inside with lateral brushes and a top brush, where the lateral brushes press against the walls of the guide elements, and wherein the top brush presses at the top on the guide elements.

* * * * *